US005868851A

United States Patent [19]

Lightner

[11] Patent Number: 5,868,851

[45] Date of Patent: Feb. 9, 1999

[54] PROCESS FOR PRODUCTION OF SOLID GLUCOSE

[76] Inventor: Gene E. Lightner, 706 SW. 29th St., Federal Way, Wash. 98023-3549

[21] Appl. No.: 908,104

[22] Filed: Aug. 11, 1997

[51] Int. Cl.[6] ..... C13D 3/16; C13F 1/04; C13F 1/06

[52] U.S. Cl. ..... 127/57; 127/53; 127/55; 127/56

[58] Field of Search ..... 127/53, 58, 56, 127/57

[56] References Cited

U.S. PATENT DOCUMENTS 5,538,637 7/1996 Hester et al. ..... 210/635

5,580,389 12/1996 Farone et al. ..... 127/46.2

*Primary Examiner*—David Brunsman

[57] ABSTRACT

A process to produce solid glucose from a hydrolyzate consisting of a mixture of glucose, water, and an acid used in the hydrolysis of a biomass material is covered herein. In the process, the hydrolyzate is concentrated, as required, to form two phases: a solid glucose phase and an acidic liquid phase. The phases are formed in a vessel where they are separated for recovery of the acidic liquid phase. The solid glucose phase, containing residual acidic liquid phase, is then extracted to remove most of the residual acid to produce solid glucose mostly free of acid. The recovered acid may then be recycled. The solid glucose may be further processed including purification and also drying.

21 Claims, 5 Drawing Sheets

PROCESS FOR PRODUCTION OF SOLID GLUCOSE

BACKGROUND OF THE INVENTION

This invention relates to a process for production of solid glucose from biomass materials, and more particularly, for means to separate the acid from the glucose and produce solid glucose for shipping to the end user (such as a gasohol plant) where glucose is fermented to form alcohol for blending with gasoline. The solid glucose can be fermented or purified and used as a food additive.

In the case of glucose fermentation, glucose can be produced from several carbohydrate containing materials such as starchy grains and cellulosic biomass materials. Starchy materials, such as corn, are converted by hydrolysis of starch to glucose by acids or enzymes. For enzyme hydrolysis, grain must be ground into mash to assure that the carbohydrates are accessible to enzymes. The mash must be sterilized before the enzymes are added and kept sterile in order for the enzymes to perform as required. The mash must be temperature and pH adjusted as required by the enzymes. Either acid or base may be required to adjust the pH. The first enzyme will convert the starch to water soluble dextrins. The second enzyme, after required temperature and pH adjustments, will hydrolyze the dextrins to glucose.

Dilute acid hydrolysis of starchy materials converts the starch to glucose. The resulting hydrolyzate must be neutralized with lime or other basic material before glucose can be used for fermentation. Biomass hydrolysis plants producing glucose, are usually operated at or near an ethanol fermenting and distilling process plant to avoid high costs of shipping dilute solutions of glucose.

Enormous amounts of cellulosic materials found in biomass are potentially convertible via hydrolysis to glucose. No practical cost-effective process for converting biomass materials to alcohol via fermentation and distillation has yet been developed. When such a process is available, a gasohol plant for starchy materials can be modified to require only a storage area for glucose. Thus, such a plant could process either starchy materials or glucose. The state of the art process usually adds dilute acid to a biomass in a reactor operating at high pressure and high temperature. Acids used for hydrolysis include sulfuric acid, hydrochloric acid, nitric acid, salts which can be hydrolyzed to form acids, and organic acids such as sulfonic acids. The hydrolyzate from the reactor contains dilute acid and dilute glucose. Large amounts of acid in the hydrolyzate, when neutralized with lime, results in high costs of acid and lime. Lime deposits form as scaling in evaporators and other equipment therefore lime may cause problems. Disposal problems often result in water pollution from neutralization. Separation of acid from the hydrolyzate by electrodialysis, ion exchange, solvent separation or other processes have the disadvantages of short equipment life, high capital costs, high operating costs, and high maintenance costs.

Also, a process for converting biomass to glucose uses low temperature and enzymes. The slow-acting process must use sterilized biomass in sterilized reactors. The costs of the enzymes is much more than that for acids.

Solid glucose manufactured for food requires pure glucose separated from impurities. Glucose from acid hydrolysis of corn starch produces a hydrolyzate that is then neutralized and purified by several steps including filtration, ion exchange, and absorption by activated charcoal to remove most of the impurities. The hydrolyzate is then concentrated via multiple-effect evaporation to remove most of the water. The resulting concentrated mixture is sent to a cooler and then to a crystallizer to form glucose crystals for separation from any remaining impurities. About 72 hours is required to form the glucose crystals. The resulting glucose crystals are separated from adhering liquor by a centrifuge. After water washing, the glucose is dried and stored for shipping.

It is therefore an object of this invention to obviate many of the limitations or disadvantages of the prior art in production of solid glucose by forming a glucose phase from a mixture of glucose and an acid.

Another object of this invention is to form a glucose phase in about 12 hours.

Still another object of this invention is to separate acid from glucose, so acid can be recovered for recycling. Recovered acid may contain glucose and can be recycled with the acid.

Additional purification of solid glucose may also be achieved to remove impurities to produce nearly pure glucose for food usage.

An additional object of this invention is to produce solid glucose from local sources of biomass for shipping to remote fermentation cites.

With the above and other objects in view, this invention relates to the novel features and alternatives and combinations presently described and pointed out in the drawings.

BRIEF DESCRIPTION OF THE INVENTION

The present invention relates to the production of solid glucose including crystals, solid amorphous glucose, or a combination of any of these, separated from an aqueous solution containing an acid.

It has been discovered that a glucose phase is produced when the glucose solubility in the aqueous solution is modified by several factors. These factors are believed to be: (a) Aqueous glucose solutions may be concentrated by removal of water. (b) Effective concentration can be achieved by constraining water formed from water of hydration from acids and salts in the above solution. (c) Aqueous solutions may be concentrated by addition of solid glucose. (d) Other factors influencing solubility of glucose in aqueous solutions are: (1) Low temperature. (2) Presence of ions found in acids and salts. (3) Time required to form two phases. The above factors may be combined in any way to produce two phases, glucose and an aqueous acidic phase. The time required to form two phases by the above factors has been found to be somewhat less than that found in prior art. The reduced time to form two phases suggests that a new fundamentally different scientific principle than that employed at the present time. Regardless of the present mode of operation, it is demonstrable that two phases are formed in much shorter times than any known processes at the present date.

The present invention, in its broadest aspect, provides a vessel to receive a concentrated mixture of glucose and an acid that continuously flows. Where the mixture forms into two phases, glucose, and an aqueous phase containing acid, the glucose phase and the aqueous phase form at the bottom of the vessel and are withdrawn continuously. The two phases, are separated by parting the glucose phase from the aqueous phase that contains the acid. The glucose, after separation from the aqueous acidic phase, is then, by extracting continuously with counter flow of solvent, freeing most of the acid that may adhere to the glucose. The resulting extraction solution may be combined with the acidic phase in the previous separation. The aqueous acid solution recovered may contain glucose, which can be recycled with the acid.

An embodiment of this invention in the above described present invention, a centrifuge is employed to provide separation of the two phases.

After forming two phases as in the previous embodiments, another embodiment of this invention employs a porous paper is to provide absorption of the acidic phase thus providing separation of the glucose phase and acidic phase.

Yet another embodiment of this invention will employ a group of solvents including acetone, methyl ethyl ketone, methanol and ethanol including a mixture of all or any of the above solvents to be added to a glucose-acid mixture to form two phases as before and will provide a continuous extraction by counter flow of the same solvent as above.

Still another embodiment of this invention will employ a group of bases including ammonium hydroxide, sodium hydroxide, and salts which will neutralize acids including a mixture of all or any of the above bases to be added to solid glucose containing a trace of acid to provide an extraction procedure.

The foregoing embodiments are achieved in general, by continuous flow of the glucose and acid mixture under pressure to apply pressure to the vessel to supply a pressure driving force for the operations of separation and extraction.

BRIEF DESCRIPTION OF THE DRAWINGS

The features that are considered characteristic of this invention are set forth in the appended claims. This invention, however, both as to its origination and method of operations as well as additional advantages will best be understood from the following description when read in conjunction with the accompanying drawings in which:

DESCRIPTION OF THE PREFERRED EMBODIMENT

Figure 1:
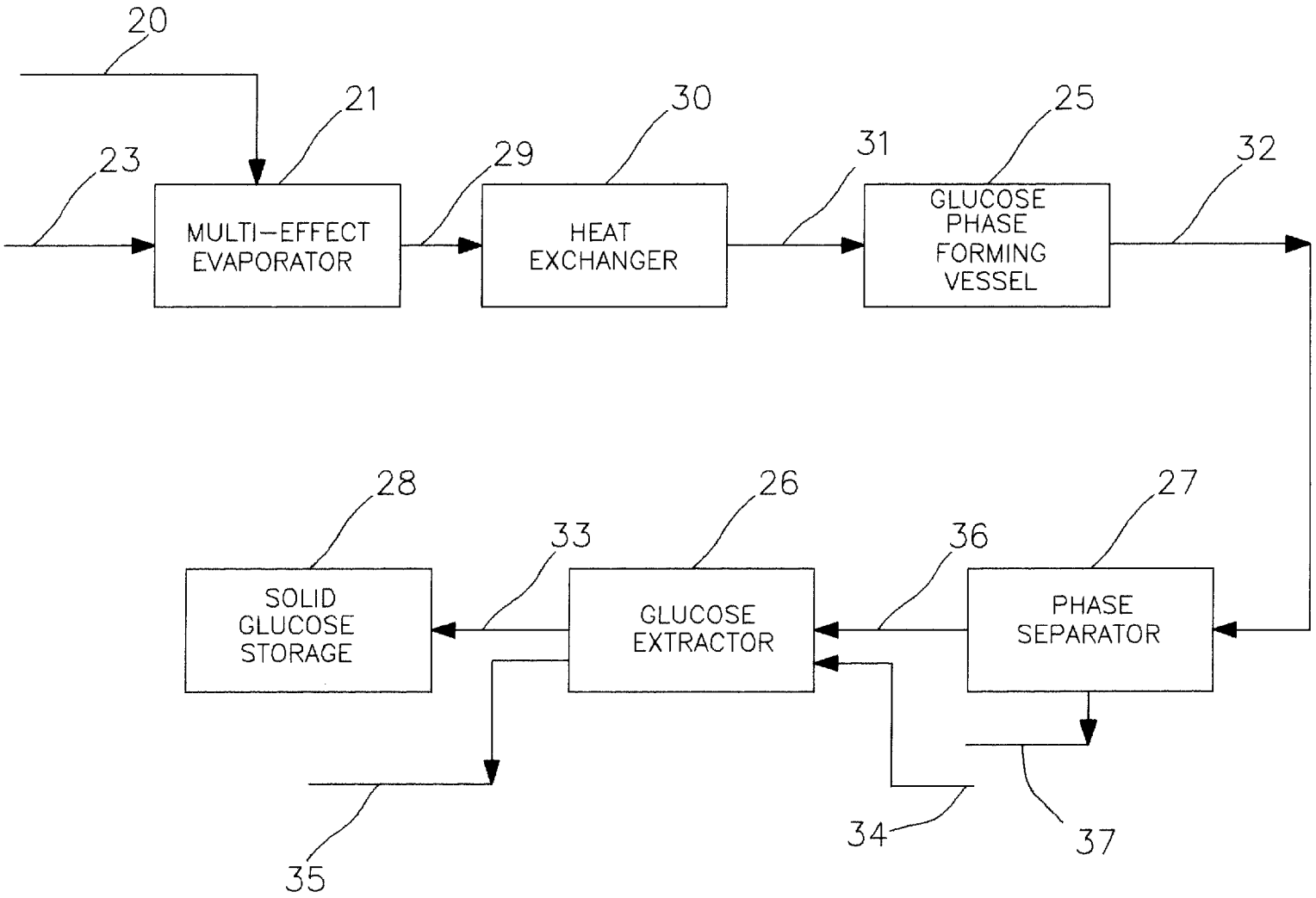
FIG. 1 is a flow sheet denoting the invention as set forth in the appended claims.

The flow diagram of FIG. 1 illustrates the general preferred embodiments of the present invention. In the diagram, rectangles represent stages or functions of the process, and not necessarily separate process components. Arrows indicate direction of flow of material in the process.

Referring to FIG. 1, dilute hydrolyzate 23 usually supplied by a biomass hydrolysis process, flows into a multiple-effect evaporator 21, often used by the chemical process industries, where a dilute hyrolysate 23 is concentrated to produce a concentrated aqueous solution 29 by removal of water 20 by evaporation. Concentrated aqueous solution flows to heat exchanger 30 where cooled concentrated solution 31 flows into a glucose-forming vessel 25 where two phases are formed in approximately four to eight hours. The two phases are a solid glucose phase and an acidic liquid phase 32. The two phases flow from the bottom of a previously mentioned glucose-forming vessel 25 to a phase separator 27 where the glucose and an acidic liquid phase 32 is filtered, often with a centrifuge commonly found in the sugar industry, to produce solid glucose 36 containing a trace of adhering acidic liquid phase. The acidic phase 37 is recycled to a biomass hydrolysis process. The solid glucose 36 then is conveyed into an extractor 26, which is typically a counter flow wash tower, to remove acid from glucose with water 34 and produces a water washing 35 for recycle which contains acid removed from solid glucose 33. Washed solid glucose 33 is conveyed to glucose storage 28. Functions 25, 26 and 27 may be combined to form a single vessel.

Figure 2:
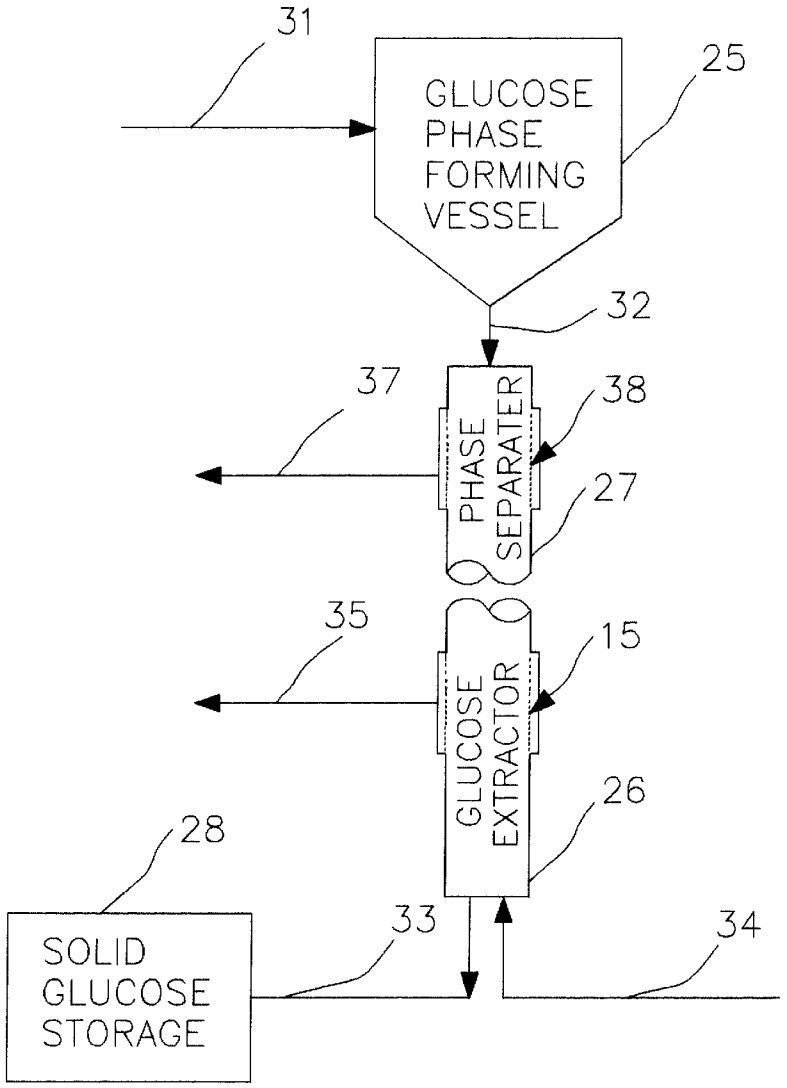
FIG. 2 is the process depicted in FIG. 1.

FIG. 2 portrays the preferred embodiment of the present invention.

Referring to the reference characters in FIG. 2, flow of a cool concentrated solution 31 flows to the glucose phase forming vessel 25. After forming two phases, the mixture of glucose and acidic liquid phase 32 flows to the glucose phase separator 27 where a filter 38 is employed for separation of the glucose phase and acidic phase to free the acid phase 37 from the solid glucose phase. The solid glucose 36, not shown as such in FIG. 2, advances to the extractor 26, where the glucose is washed via counter flow of water 34. Washings 35, which are recycled, are thus divided with an extractor filter 15. Washed solid glucose 33 is conveyed to glucose storage 28. As before, functions 25, 26 and 27 may be combined to form a single vessel. A continuous process portrayed in FIG. 2 is envisioned.

Figure 3:
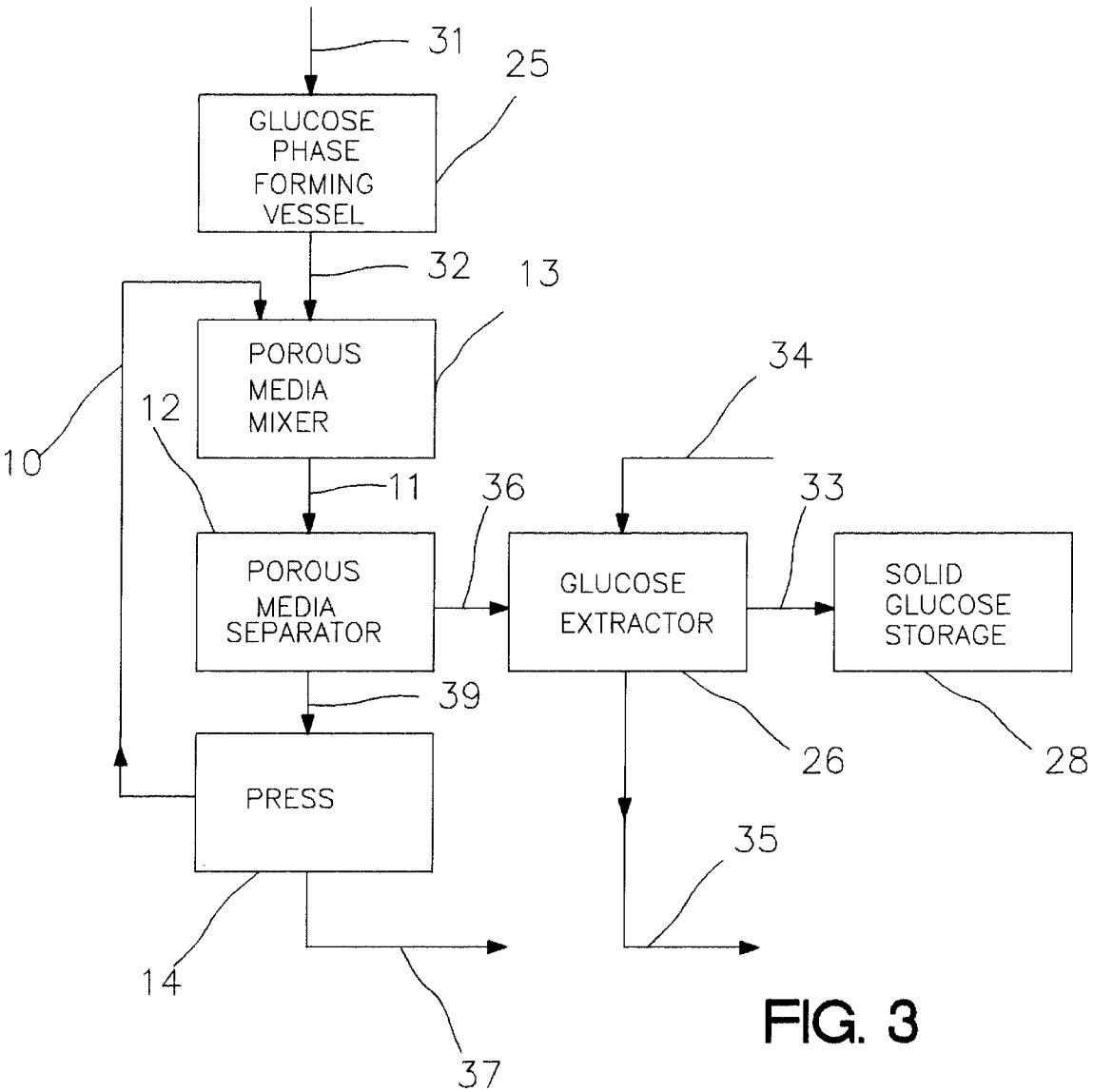
FIG. 3 is a flow sheet indicating acid separated by absorption on a porous media.

FIG. 3 portrays an alternate embodiment of the present invention.

Referring to the reference characters in FIG. 3, flow of a cool concentrated solution 31 flows to the glucose phase forming vessel 25, after forming a glucose and acidic liquid phase 32, the mixture of glucose and acidic liquid phase 32, advances to the porous media mixer 13, where the acidic phase is absorbed by the porous media 10. Porous media with the solid glucose 11 are conveyed to a porous media separator 12 and the solid glucose 36, containing acid, is extracted by water 34 in a counter flow glucose extractor 26 to produce washings 35 for recycling. Washed solid glucose 33 advances to glucose storage 28. Acid is absorbed on the porous media 39, and is then pressed in a standard press 14 to separate to an aqueous acid phase 37 thus freeing the porous media 10 to be recycled to the porous media mixer 13 for continued use in absorption.

Figure 4:
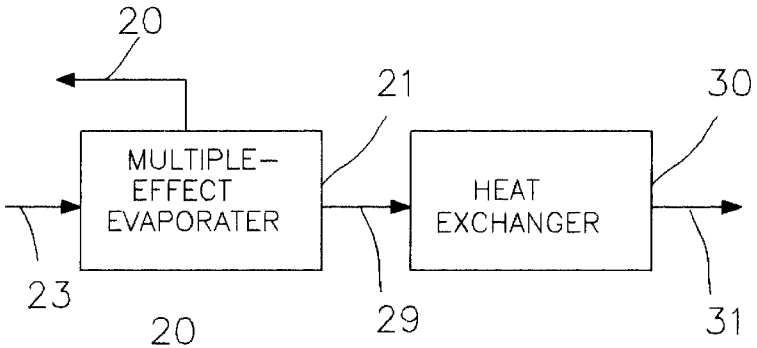
FIG. 4 is a flow sheet showing a manner of producing concentrated solutions of glucose and acid employing a multiple-effect evaporator.
Figure 5:
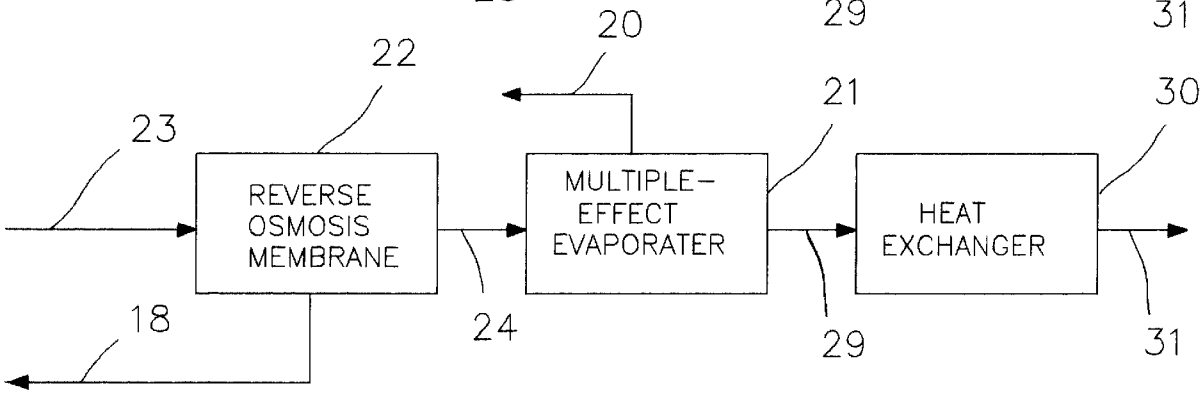
FIG. 5 is a flow sheet indicating an alternate manner of producing concentrated solutions of glucose and acid, employing a reverse osmosis membrane system and a multiple-effect evaporator.
Figure 6:
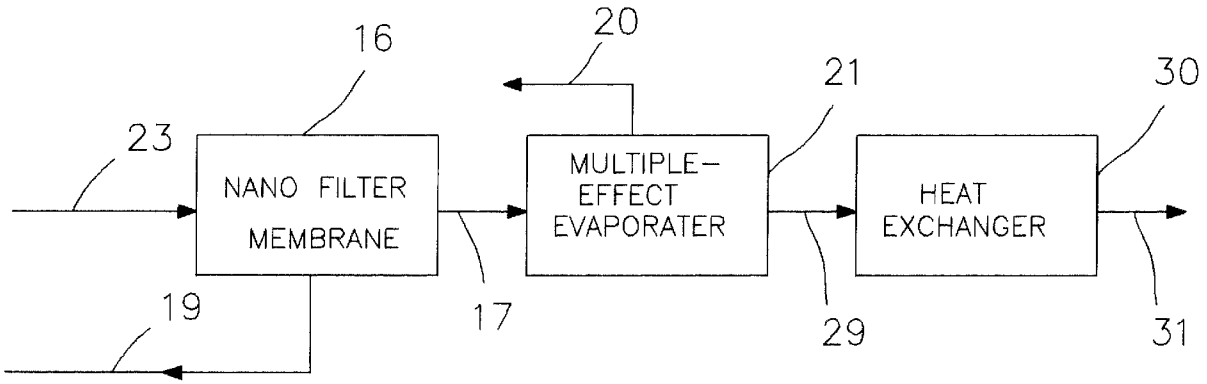
FIG. 6 is a flow sheet denoting an alternate manner of producing concentrated solutions of glucose and acid, employing a nano filter membrane system and a multiple-effect evaporator.

FIGS. 4, 5 and 6 depicts alternatives for concentrating hydolyzate composed of dilute aqueous mixtures of glucose and an acid.

Referring to FIG. 4, dilute hydrolyzate 23 flows into a multiple-effect evaporator 21, where the dilute hydrolyzate is concentrated to produce a concentrated solution 29 by removal of water 20 by evaporation. Concentrated solution 29 flows to the heat exchanger 30 where the solution is cooled. The cooled concentrated solution 31 is now in readiness to form two phases in the glucose-forming vessel 25. The vessel 25 is not shown in FIG. 4.

Referring to FIG. 5, dilute hydrolyzate 23 flows into a reverse osmosis membrane 22 to produce semi-concentrated solution 24 hydrolyzate and then flows to a multiple-effect evaporator 21 where it is concentrated to produce a concentrated solution 29 by removal of water 20 by evaporation. Concentrated solution 29 flows to the heat exchanger 30 where the solution is cooled. The cooled, concentrated solution 31 is now in readiness to form two phases in the glucose-forming vessel 25. Vessel 25 is not shown in FIG. 5 Reverse osmosis membrane permeate 18 contains water, and may contain acid.

Referring to FIG. 6, dilute hydrolyzate 23 flows into a nano filter membrane 16 to produce a semi-concentrated solution 17, and then flows to the multiple-effect evaporator 21, where it is concentrated to produce a concentrated solution 29 by removal of water 20 by evaporation. Concentrated solution 29 flows to the heat exchanger 30 where the solution is cooled. The cooled concentrated solution 31 is now in readiness to form two phases in the glucose-forming vessel 25. Vessel 25 is not shown in FIG. 6. The Nano filter membrane permeate 19 contains water and may contain acid.

Figure 7:
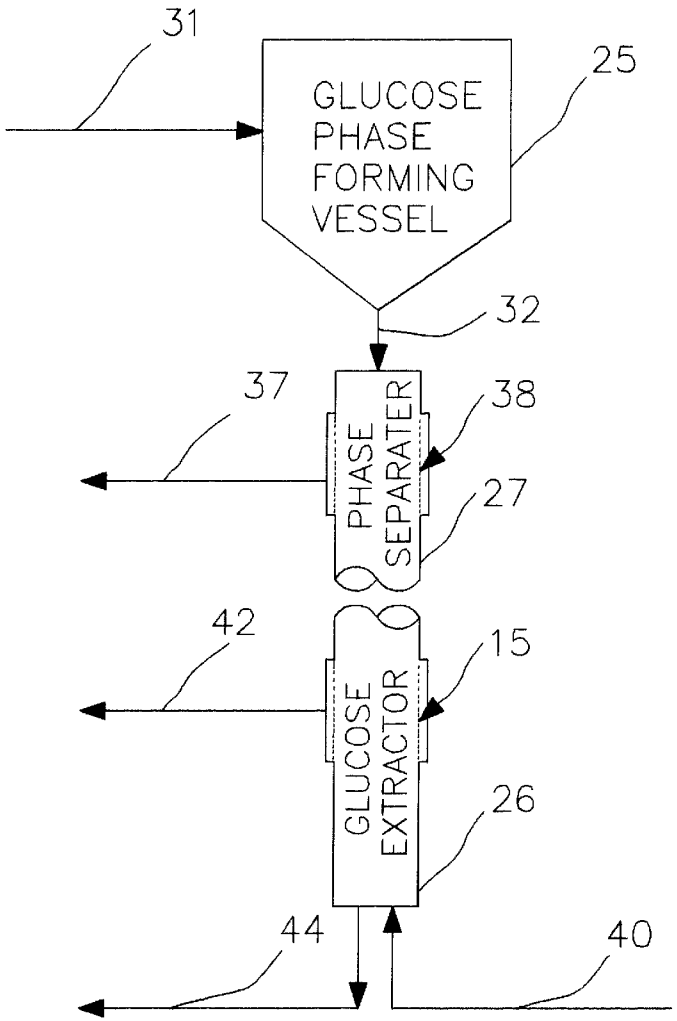
FIG. 7 is the process depicted in FIG. 1 using a solvent other than water.

FIG. 7 portrays the preferred embodiment of the present invention.

Referring to the reference characters in FIG. 7, flow of a cool concentrated solution 31 flows to the glucose phase forming vessel 25. After forming two phases, the mixture of glucose and acidic liquid phase 32 flows to the glucose phase separator 27 where a filter 38 is employed for separation of the glucose phase and acidic phase to free the acid phase 37 from the solid glucose phase. The solid glucose 36, not shown as such in FIG. 7, advances to the extractor 26, where the glucose is washed via counter flow of solvent 40. Washings containing solvent and acid 42 are recovered, and are divided with extractor filter 15. Washed solid glucose 44, requires solvent recovery. As before, functions 25, 26 and 27 may be combined to form a single vessel. A continuous process portrayed in FIG. 7 is envisioned.

The following examples are set forth to illustrate more clearly the principles and practice of the invention. Where parts or quantities are mentioned, the parts or quantities are by weight.

EXAMPLE 1

Twenty five grams of solution containing 16% sulfuric acid are placed in a 100 cc beaker. Twenty five grams of glucose are added to the acid solution. The mixture is heated in a water bath at 65° C. and briefly stirred to dissolve the glucose. The solution is cooled to room temperature and about 0.5 gram of solid glucose seed is added to the solution. The solution is allowed to remain at room temperature for about five hours. After about five hours a glucose phase and an acidic phase are formed.

EXAMPLE 2

Thirty grams of solution containing 10% sulfuric acid are placed in a 100 cc beaker. Twenty grams of glucose are added to the acid solution. The mixture is heated in a water bath at 65° C. and briefly stirred to dissolve the glucose. The solution is cooled to room temperature and about 0.5 gram of solid glucose seed is added to the solution. The solution is allowed to remain at room temperature for about ten hours. After about ten hours a glucose phase and an acidic phase are formed.

EXAMPLE 3

To the resulting phases from Example 1, the contents of the beaker were placed upon fifteen grams of filter paper. Subsequent to standing over night, the glucose phase was separated from the paper and the paper was found to weigh 39 grams. The glucose phase weighed 26 grams. Thus one gram of the residual acidic phase remained with the glucose phase.

EXAMPLE 4

The resulting phases from Example 2 were placed in a nylon filter contained in a funnel. The filtrate was collected in a beaker. The filtrate was found to weigh 28 grams. The glucose phase weighed 22 grams. Thus two grams of the residual acidic phase remained with the glucose phase.

EXAMPLE 5

Part A

Fifty grams of solution containing 10% sulfuric acid are placed in a 250 cc beaker. Fifteen grams of anhydrous aluminum sulfate are added to the acid solution. The mixture is heated in a water bath at 85° C. and stirred for about ten minutes to dissolve the salt. The solution is cooled to room temperature and twenty five grams of glucose are added to the solution. The mixture was heated in a water bath at 65° C. and briefly stirred to dissolve the glucose. The solution was cooled to 5° C. and about 0.5 gram of solid glucose seed was added to the solution. The solution was allowed to remain at 5° C. for about ten hours. After about ten hours a glucose phase and an acidic phase were formed.

Part B

To the resulting phases from PART A above, the contents of the beaker were placed upon fifteen grams of filter paper. Subsequent to standing over night, the glucose phase was separated from the paper and the paper was found to weigh 64 grams. The glucose phase weighed 26 grams. Thus, after separating, one gram of the acidic phase remained with the glucose phase.

EXAMPLE 6

Part A

Forty grams of solution containing 10% sulfuric acid are placed in a 250 cc beaker. Sixty grams of glucose are added to the acid solution. The mixture is heated in a water bath at 65° C. and briefly stirred to dissolve the glucose. The solution is cooled to room temperature and about 0.5 gram of solid glucose seed is added to the solution. The solution is allowed to remain at room temperature for about ten hours. After about ten hours a glucose phase and an acidic phase are formed. The resulting phases were placed in a nylon filter contained in a funnel. The filtrate was collected in a beaker and discarded. The glucose phase weighed 82 grams and was used in PART B, below.

Part B

Forty five grams of solution containing 10% sulfuric acid are placed in a 250 cc beaker. Five grams of glucose are combined with the glucose phase obtained above in PART A. The above mixture is heated in a water bath at 65° C. and briefly stirred to dissolve the glucose. The solution is cooled to room temperature and about 0.5 gram of solid glucose seed is added to the solution. The solution is cooled to about 5° C. and allowed to form two phases in about 16 hours.

EXAMPLE 7

Forty grams of solution containing 10% sulfuric acid are placed in a 250 cc beaker. Sixty grams of glucose are added to the acid solution. The mixture is heated in a water bath at 65° C. and briefly stirred to dissolve the glucose. The solution is cooled to room temperature and about 0.5 gram of solid glucose seed is added to the solution. Seventy grams of the resulting solution are placed in a Tygon tube, having a plug located at the bottom of the tube, and allowed to remain at room temperature for about ten hours. After about ten hours a glucose phase and an acidic phase are formed. The remaining thirty grams of solution was discarded. The resulting phases formed in the tube were filtered by a nylon filter, after removing the plug contained at the bottom of the tube. The filtrate was collected in a beaker and discarded. In the tube the glucose was washed with ten grams of water. After filtering, as above, the filtrate was collected in a beaker and discarded The glucose remaining, after extracting with water, weighed thirty five grams. Five grams of washed glucose was dissolved in ninety five grams of water to form a solution of about 5% glucose in water. The pH of the resulting solution was measured with pH paper and was found to have a pH of about 2 to 3.

EXAMPLE 8

Forty grams of solution containing 10% sulfuric acid are placed in a 250 cc beaker. Sixty grams of glucose are added to the acid solution. The mixture is heated in a water bath at 65° C. and briefly stirred to dissolve the glucose. The solution is cooled to room temperature and about 0.5 gram of solid glucose seed is added to the solution. Seventy grams of the resulting solution are placed in a Tygon tube, having a plug located at the bottom of the tube, and allowed to remain at room temperature for about ten hours. After about ten hours a glucose phase and an acidic phase are formed. The remaining thirty grams of solution was discarded. The resulting phases formed in the tube were filtered by a nylon filter, after removing the plug contained at the bottom of the tube. The filtrate was collected in a beaker and discarded. In the tube the glucose was washed with thirty grams of acetone. After filtering, as above, the filtrate was collected in a beaker and discarded The glucose remaining, after extracting with acetone, weighed thirty nine grams. Five grams of washed glucose was dissolved in ninety five grams of water to form a solution of about 5% glucose in water. The pH of the resulting solution was measured with pH paper and was found to have a pH of about 6 to 7.

From the examples, one can see that a wide range of concentrations, temperatures and times will form two phases of glucose, and an aqueous phase containing sulfuric acid.

The conditions required to form two phases include: range of glucose concentration is about 10% to about 80%, range of sulfuric acid is about 10% to about 20%, range of anhydrous aluminum sulfate is about 0% to about 25%, temperature is about 30° C. to about 5° C.

The above conditions may be adjusted to effect the time to form two phases from about two hours to about twenty hours. Any of the above conditions may be used to form two phases.

The preceding examples are set forth to illustrate the principles of the invention and one skilled in the art can make adjustments or variations without departing from the spirit and scope of the invention.

What is claimed is:

1. A process for producing solid glucose from an aqueous solution including a mixture of glucose and an acid; said solution being capable of forming two phases, which comprises:

providing a vessel in which a solid glucose phase and an acidic liquid phase are formed;

separating means for parting the solid glucose phase and the acidic liquid phase; and extracting means for freeing most of any residual acid from the solid glucose, thereby providing nearly acid free solid glucose.

2. The process of claim 1 wherein the means for separating said solid glucose phase is a filter to separate most of said acidic liquid phase from said solid glucose phase.

3. The process of claim 1 wherein the means for separating said solid glucose phase is a centrifuge to separate most of said acidic liquid phase from said solid glucose phase.

4. The process of claim 1 wherein the means for separating said solid glucose phase containing acid is separated by absorption of most of said acidic liquid phase on a porous material.

5. The process of claim 1 wherein the means for separating said solid glucose phase containing acid is separated by absorption of most of said acidic liquid phase on a cellulosic material.

6. The process of claim 1 wherein the process is continuous.

7. The process of claim 1 wherein the acid is an inorganic acid.

8. The process of claim 1 wherein the acid is sulfuric acid.

9. The process of claim 1 wherein the acid is a salt hydrolyzed by water forming an acid.

10. The process of claim 1 wherein the said means for extracting employs counter flow water washing.

11. The process of claim 1 wherein the said means for extracting employs counter flow of a solvent selected from the group consisting of ketones, and alcohols including an individual or a combination of any of these solvents thereof.

12. The process of claim 1 wherein the said means for extracting employs a base selected from the group consisting of hydroxides and salts capable of neutralizing acid including an individual or a combination of any of these bases thereof.

13. The process of claim 1 wherein said aqueous solution is additionally concentrated by addition of solid glucose to said aqueous solution.

14. The process of claim 1 wherein said aqueous solution is formed from a hydrolyzate consisting of a dilute aqueous mixture, concentrating the dilute mixture by removing water to create the aqueous solution to form a glucose phase and an aqueous phase.

15. The process of claim 14 wherein the concentration means is a evaporator.

16. The process of claim 15 wherein the concentration means is a multiple-effect evaporator.

17. The process of claim 14 wherein the concentration means is a reverse osmosis membrane.

18. The process of claim 17 wherein the concentration means is a nano filter membrane.

19. The process of claim 14 wherein the concentration means is a combination of a multiple-effect evaporator and a reverse osmosis membrane.

20. The process of claim 14 wherein the concentration means is a combination of a multiple-effect evaporator and a nano filter membrane.

21. The process of claim 1 wherein said aqueous solution has a concentration of glucose in the range of about 10–80%, the sulfuric acid is in the range of about 10–20%, anhydrous aluminum sulfate is in the range of about 0–25%, and temperature in 0°–30° C.

* * * * *